US006038792A

United States Patent [19]

Hauter

[11] Patent Number: 6,038,792

[45] Date of Patent: Mar. 21, 2000

[54] SOCCER SHOE COVER

[76] Inventor: Bradley David Hauter, 433 Harvest Gate Rd., Lith, Ill. 60102

[21] Appl. No.: 08/898,964

[22] Filed: Jul. 23, 1997

[51] Int. Cl.[7] ..... A43B 1/10; A43B 3/16; A43B 3/18

[52] U.S. Cl. ..... 36/133; 36/7.1 R; 36/7.3; 36/72 R

[58] Field of Search ..... 36/7.2, 7.4, 7.7, 36/7.3, 101, 133, 132, 72 R, 7.1 R

[56] References Cited

U.S. PATENT DOCUMENTS

| | | | |
|---|---|---|---|
| D. 376,041 | 12/1996 | Nitz | D2/946 |
| 892,171 | 6/1908 | Mapes | 36/7.4 |
| 2,079,331 | 5/1937 | Nyhagen | 36/7.4 |
| 2,260,138 | 10/1941 | Feinberg . | |
| 2,436,187 | 2/1948 | Bestland | 36/7.1 R |
| 2,785,481 | 3/1957 | Joseph . | |
| 2,970,390 | 2/1961 | Brough et al. | 36/7.3 |
| 3,191,321 | 6/1965 | Brutting . | |
| 3,250,025 | 5/1966 | Crescent | 36/7.1 R |
| 3,284,931 | 11/1966 | Dassler | 36/54 |
| 3,319,362 | 5/1967 | Gomolka | 36/72 R |
| 3,348,842 | 10/1967 | Stern | 36/133 |
| 3,486,248 | 12/1969 | Olson et al. | 36/7.3 |
| 3,525,165 | 8/1970 | Randall, Jr. | 36/7.3 |
| 3,559,309 | 2/1971 | Taylor | 36/7.3 |
| 4,010,558 | 3/1977 | Slusher | 36/7.3 |
| 4,204,346 | 5/1980 | Fugere | 36/114 |
| 4,422,249 | 12/1983 | Hannah | 36/133 |
| 4,665,633 | 5/1987 | Edgerton | 36/72 R |
| 4,713,895 | 12/1987 | Vallieres | 36/7.1 R |
| 5,144,759 | 9/1992 | Mascotte | 36/72 R |
| 5,251,386 | 10/1993 | Diaz | 36/72 R |
| 5,272,822 | 12/1993 | Diaz | 36/72 R |
| 5,396,717 | 3/1995 | Bell | 36/7.3 |
| 5,437,112 | 8/1995 | Johnston | 36/133 |
| 5,544,430 | 8/1996 | Jacko | 36/7.2 |
| 5,555,650 | 9/1996 | Longbottom et al. | 36/133 |

*Primary Examiner*—Paul T. Sewell
*Assistant Examiner*—Anthony Stashick
*Attorney, Agent, or Firm*—Fitch, Even, Tabin & Flannery

[57] ABSTRACT

A soccer shoe cover includes a rubber membrane formed to stretch over the exterior surface of a soccer shoe. The membrane covers the laces, the heel and a kicking portion of the soccer shoe while leaving the toe uncovered. The membrane has a rear opening for inserting the soccer shoe and a front opening for exposing the toe. The membrane provides a kicking surface that remains substantially smooth over shoe laces when the membrane is fitted over the soccer shoe.

11 Claims, 1 Drawing Sheet

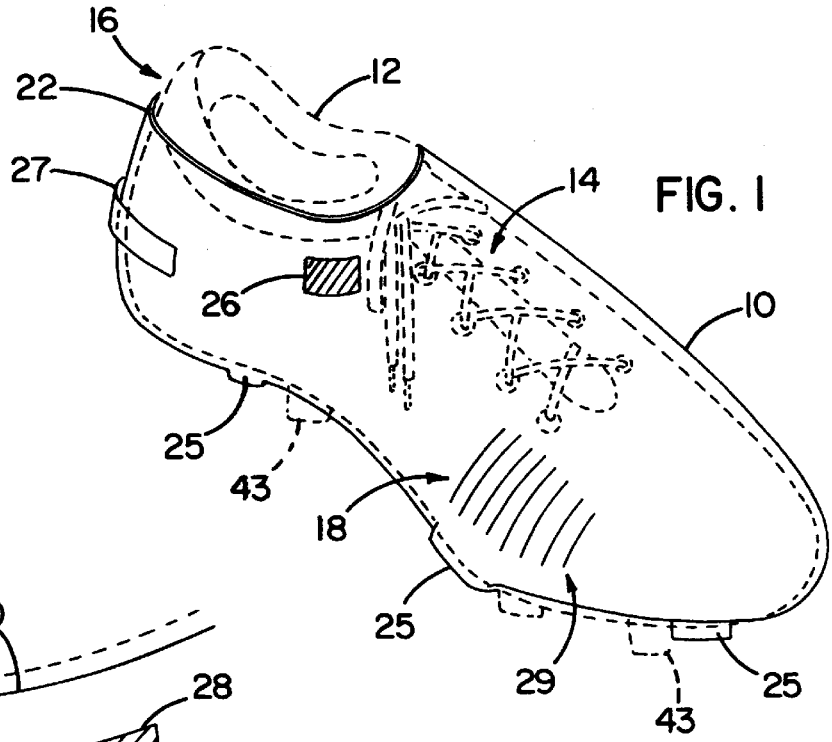
FIG. 1
FIG. 2
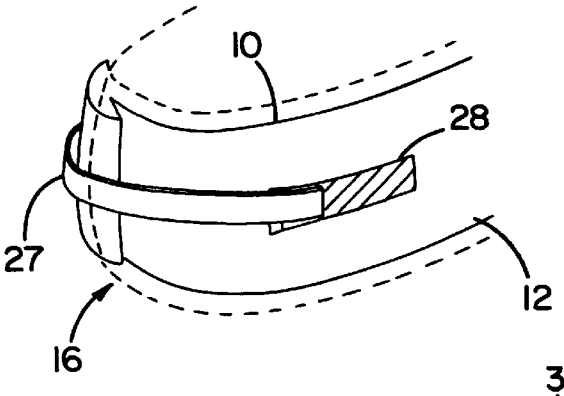
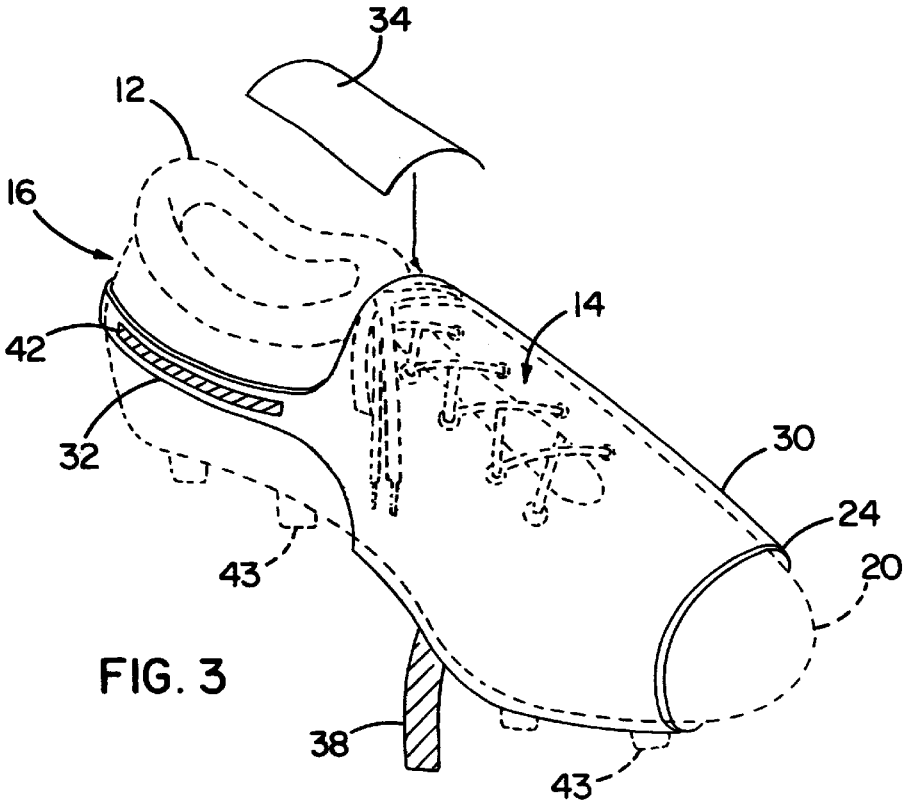
FIG. 3

SOCCER SHOE COVER

TECHNICAL FIELD

The present invention relates generally to athletic equipment and, in particular, to a sleeve covering the exterior of an athletic shoe.

BACKGROUND OF THE INVENTION

Soccer is the most popular team sport in the world. The game is played primarily by kicking a ball. Consequently, the outcome of a soccer match depends on the players' ability to properly control the ball with their feet. An experienced player relies on "touch" to maintain control of the ball. "Touch" refers to the physical sensation a player feels with his foot while manipulating the ball.

The shoes worn by players greatly affect their touch. One problem that occurs with soccer shoes is the degradation of the shoe's exterior surface as the shoe ages. As a consequence of use, a shoe's kicking surface becomes worn, causing inconsistent touch and ball control. Another problem with soccer shoes is that their laces frequently interfere with the contact between the ball and shoe. This interference can result in a loss of ball control. Because ball control is a critical part of playing soccer, there is a need for an improvement to overcome the forgoing problems of currently available soccer shoes.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

FIG. 1 is a perspective view of a soccer shoe cover conforming to a first embodiment of the present invention;

FIG. 2 is a detailed view of the heel portion of the shoe cover of FIG. 1; and FIG. 3 is a perspective view of a soccer shoe cover in accordance with a second embodiment of the present invention.

DETAILED DESCRIPTION OF A PREFERRED EMBODIMENT

It is an advantage of the present invention to provide a low cost shoe cover that reduces wear on a soccer shoe, thereby maintaining a more consistent touch over the life of the shoe. Another advantage of the present invention is that it provides a shoe cover that conceals the shoe laces so they do not interfere with ball contact.

Referring to FIG. 1, an embodiment of the shoe cover comprises a membrane 10 formed to stretch over the exterior surface of a soccer shoe 12 to cover the laces 14, the heel 16 and a kicking portion 18 of the soccer shoe 12. The membrane has a back opening 22 for inserting the soccer shoe 12.

Attached to an interior surface of the membrane 10 is a fastener 26. The fastener 26 is preferably a hook and loop fastener. A hook and loop fastener includes a hook portion and a loop portion. To use a hook and loop fastener, one portion is mounted on the soccer shoe 12 and the other portion is correspondingly mounted on the membrane 10. The two portions are then enmeshed to detachably couple the membrane 10 to the soccer shoe 12.

A plurality of sole straps 25 are used to secure the membrane to the soccer shoe 12. The sole straps 25 pass under the shoe and attach to opposite sides of the membrane 10. Preferably, the sole straps 25 are continuations of the membrane 10 that engage the sole of the soccer shoe 12. The sole straps 25 can include hook and loop fasteners.

A series of grooves 29 can be embossed into the exterior kicking surface of the membrane 10. The grooves 29 can be vertical, horizontal, or cross-hatched. In addition, the kicking surface can include protruding ridges or bumps (not shown). The grooves and protrusions can alter the frictional characteristics of the kicking surface to enhance ball control. For instance, the grooves can improve a shoe's "bite" on the ball, that is, the shoe's ability to put spin on the ball when it is kicked. In turn, this allows a player to more effectively curve the trajectory of the kicked ball.

The term kicking surface refers to the part of the membrane 10 that covers the kicking portion 18 of the soccer shoe. The kicking portion 18 is generally located at the front instep sidewall of the soccer shoe. Preferably, the kicking surface of the membrane 10 remains substantially smooth, i.e., less bumpy than exposed laces, when the membrane 10 is fitted over the soccer shoe 12.

The membrane 10 is made from a stretchable material having elastic properties, such as latex rubber. Typically, the membrane 10 has a substantially uniform thickness of 1–2 millimeters. However, various embodiments of the present invention have a membrane that varies in thickness. For instance, the kicking surface of the shoe cover can have a greater thickness than other areas of the cover. This compensates for the greater wear on the kicking surface caused by frequent ball contact.

The shoe cover is made by manufacturing the membrane 10 to snugly fit a particular soccer shoe. The membrane 10 can be formed or molded by any known method. For example, a dipping process can be used to produce a strong, yet thin membrane. Using this process, a mold of the soccer shoe is made. To produce the shoe cover, the mold is then dipped in hot liquid rubber and then removed, leaving a thin layer of rubber on the mold. The dipping can be repeated to obtain a greater thickness of the shoe cover. When the layer has cooled and solidified, it is peeled away from the mold.

The shoe cover could also be manufactured using an injection molding process in which the stretchable material is injected into a hollow mold made from the soccer shoe.

FIG. 2 is a detailed diagram of the heel portion of the shoe cover shown in FIG. 1. Mounted on one side of the membrane 10 is a heel strap 27 for adjusting the tautness of the elastic membrane 10. To adjust the taughtness, the heel strap 27 is pulled around the heel 16 and detachably fastened to the opposite side of the membrane 10 with anchor 28, which is mounted on the membrane 10. The membrane 10 can fold over itself at the heel 16 to take up slack. The heel strap 27 and anchor 28 are preferably implemented using a hook and loop fastener.

FIG. 3 depicts a soccer shoe cover in accordance with a second embodiment of the present invention. The soccer shoe cover includes a stretchable membrane 30 covering the kicking portion 18 and laces 14 of the soccer shoe 12 while leaving the toe 20 uncovered. The membrane 30 includes a rear strap 32 for pulling around the heel 16 to tightly fit the cover to soccer shoe 12. A hook and loop fastener strip 42 is mounted on the interior surface of the rear strap 32 for detachably fastening the rear strap 32 to the soccer shoe 12.

The membrane 30 has a front opening 24 for exposing the toe 20. Typically, the toe 20 is not used for kicking a soccer ball. By exposing the toe 20, the amount of material used to manufacture the shoe cover is reduced, thus reducing the overall cost.

A hook and loop fastener 36 is used to secure the frontal portion of the membrane 30 to the soccer shoe 12. A hook strap 38 and a loop strap (not shown) are connected to opposite sides of the lower portion of the membrane 30. The hook and loop straps are detachably coupled by overlapping one another across the sole of the soccer shoe 12.

Alternatively, the frontal portion of the membrane 30 can be secured to the soccer shoe 12 by forming the membrane 30 to snugly encircle the entire circumference of the frontal portion of the soccer shoe 12, including the sole. Holes can be included in the membrane 30 to allow the cleats 43 of the soccer shoe 12 to pass through the membrane 30.

The shoe cover also includes a shield 34 that is inserted between the membrane 30 and the exterior surface of the soccer shoe 12. The shield can be made of rigid or semi-rigid material such as aluminum, plastic, or compressed foam rubber. When inserted, the shield 34 forms a cavity for storing the laces 14. This allows a smoother kicking surface. The shield 34 is curved to fit over the laces 14 and is held in place by the membrane 30.

In summary, there has been described herein a concept, as well as a preferred embodiment, of a shoe cover that can be used to enhance the performance of soccer shoes. Because the various embodiments of the shoe cover as herein-described are relatively thin and hide the laces of a soccer shoe, they can improve a player's touch and ball control. Furthermore, the embodiments of the shoe cover protect the kicking portion of the soccer shoe from wear, thus extending the useful life of the shoe. In addition, the embodiments of the disclosed shoe cover can include grooves on their kicking surfaces, which provide better bite on the ball.

While specific embodiments of the present invention have been shown and described, it will be apparent to those skilled in the art that the disclosed invention may be modified in numerous ways and may assume many embodiments other than the preferred form specifically set out and described above.

Accordingly, it is intended by the appended claims to cover all modifications of the invention which fall within the true spirit and scope of the invention.

What is claimed is:

1. A soccer shoe cover for covering a soccer shoe having a heel, a kicking portion located along an instep sidewall, and a front top portion located above the instep sidewall, comprising:

a thin, elastic membrane formed to stretch over the exterior surface of a soccer shoe to cover the front top portion, the heel and the kicking portion of the soccer shoe, the elastic membrane having an opening for inserting the soccer shoe and a kicking surface for covering at least the kicking portion and the front top portion, wherein the kicking surface remains substantially smooth over the front top portion when the elastic membrane is fitted over the soccer shoe and a portion of the elastic membrane defining the kicking surface is thicker than other portions of the elastic membrane; and a fastener, connected to the elastic membrane, for detachably fastening the soccer shoe cover to the soccer shoe.

2. The soccer shoe cover of claim 1, wherein the fastener is a hook and loop fastener.

3. The soccer shoe cover of claim 2, wherein the fastener comprises:

a hook strap and a loop strap connected to opposite sides of the elastic membrane, wherein the hook and loop straps are detachably coupled by overlapping one another across the sole of the soccer shoe.

4. The soccer shoe cover of claim 2, wherein the hook and loop fastener is connected to an interior surface of the elastic membrane.

5. The soccer shoe of claim 1, further comprising:

a hook and loop fastener, mounted on the heel section of elastic membrane, for adjusting the tautness of the elastic membrane.

6. The soccer shoe cover of claim 1, wherein the elastic membrane entirely covers laces located on the front top portion of the soccer shoe.

7. The soccer shoe cover of claim 1, wherein the elastic membrane is formed as a single piece to snugly fit a predetermined soccer shoe having a particular shape and size.

8. The soccer shoe cover of claim 1, wherein the kicking surface includes a plurality of raised protrusions.

9. The soccer shoe cover of claim 1, wherein the kicking surface of the elastic membrane includes grooves.

10. The soccer shoe cover of claim 9, wherein the grooves are substantially vertical or substantially horizontal.

11. The soccer shoe cover of claim 9, wherein the grooves are cross-hatched.

* * * * *